US007448155B2

(12) United States Patent
Dolas

(10) Patent No.: US 7,448,155 B2
(45) Date of Patent: Nov. 11, 2008

(54) MONEY CLIP

(76) Inventor: Michael Dolas, 1164 Crestline Dr., Santa Barbara, CA (US) 93105

( * ) Notice: Subject to any disclaimer, the term of this patent is extended or adjusted under 35 U.S.C. 154(b) by 439 days.

(21) Appl. No.: 11/271,113

(22) Filed: Nov. 10, 2005

(65) Prior Publication Data

US 2007/0101552 A1 May 10, 2007

(51) Int. Cl.
*G09F 3/20* (2006.01)

(52) U.S. Cl. ..... 40/659; 24/67.9; 24/546; 24/552; 24/555; 150/137

(58) Field of Classification Search ..... 40/658, 40/659, 666; 24/67.9, 67.11, 552, 546, 555; 150/137; D19/65
See application file for complete search history.

(56) References Cited

U.S. PATENT DOCUMENTS

| | | | | | |
|---|---|---|---|---|---|
| 703,485 | A * | 7/1902 | Shedlock | 24/552 |
| 741,408 | A * | 10/1903 | McGill | 24/561 |
| 1,176,210 | A * | 3/1916 | Farley | 24/560 |
| 1,840,409 | A * | 1/1932 | Randall | 24/67.11 |
| 1,840,604 | A * | 1/1932 | Randall | 24/67.11 |
| 1,851,013 | A * | 3/1932 | Michaud et al. | 24/67.11 |
| D178,357 | S * | 7/1956 | Galef | D19/65 |
| 4,056,139 | A * | 11/1977 | Murt | 150/137 |
| 4,324,025 | A * | 4/1982 | Apri | 24/552 |
| 5,146,768 | A * | 9/1992 | Dichtel | 63/14.8 |
| D454,087 | S * | 3/2002 | Braner | D11/78.1 |
| 2006/0097510 | A1 * | 5/2006 | Sharpe | 283/36 |

* cited by examiner

*Primary Examiner*—Gary C Hoge
(74) *Attorney, Agent, or Firm*—Laura Tunnell; Michael Petit

(57) ABSTRACT

A money clip for organizing and storing paper bills such as currency. The money clip includes a single length of wire having two free ends which form a clasping portion and a flap attached thereto. The two free ends of the wire have spherical elements attached thereto to cover the free ends. The wire is folded symmetrically with respect to a straight base portion to provide a "butterfly-like" configuration; the base portion being "the body" of the butterfly, and the folded portions on either side of the base forming "the wings" of the butterfly. The flap is a substantially flat, disc-shaped member affixed to the base portion along a diameter thereof such that the base portion is substantially colinear with a diameter of the flap. A portion of the flap covers a portion of the clasping portion disposed adjacent the base portion and serves to maintain the correct orientation of the bills in the clip.

2 Claims, 1 Drawing Sheet

MONEY CLIP

BACKGROUND OF THE INVENTION

1. Field of the Invention

The present invention relates to a money clip operable for holding and organizing paper currency and the like.

2. Prior Art

Money clips are designed to hold paper currency in an organized folded condition, with quick access. It addition, they may hold credit cards and/or business cards. Some people prefer money clips for holding a small amount of paper money in a clothes pocket, since other money holders, including wallets, bulge the pocket. A money clip should be simple to use, hold the bills securely in a desired orientation, and permit easy insertion and removal of the bills. Examples of disclosures teaching the construction and use of such money clips are presented in U.S. Pat. Nos. 6,823,910, 6,453,236, 6,327,749, 6,082,422 5,913,618 and 5,697,131.

A money clip may be used to hold either a single paper bill folded in half or a plurality of such bills. Many money clips that accept a large number of folded bills do not exert sufficient force to hold a single bill in the clip. After a clip has been extended to accept a plurality of bills, the material of a clip can exceed the elastic limits of the spring material and transition to a more or less nonelastic state and assume a new shape. The new distorted shape may provide less holding force on a small number of bills; rendering the clip inoperable for securely holding a small number of bills. As a money clip may be required to hold 1 to at least 20 bills, the clip must be adapted to be elastically deformable over a range of deformation required for storage of a large number of bills.

SUMMARY

The present invention is directed to a money clip that substantially obviates one or more of the limitations of the related art. To achieve these and other advantages and in accordance with the purpose of the invention, as embodied and broadly described herein, the money clip of the present invention includes a length of spring wire (~35 cm) having an outer diameter preferably ~0.2 cm. The spring wire has two free ends. Each of the free ends is terminated by a spherical bead having an axial bore with a bore diameter greater than or equal to the outer diameter of the wire. While the outer diameter of the bead may be any size, it is preferably about 0.5 cm. The bead is attached to the free end of the wire by inserting the free end of the wire into the axial bore in the bead and affixing the bead thereto. A base portion of the wire is defined as a portion of the wire having a length preferably between 4-5 cm that is centered on the length of wire. The clasping portion of the wire is formed by bending the respective portions of wire laterally disposed with respect to the base portion to make a first bend having a first bending angle of about 60° with respect to the base portion, the plane containing the two free ends and the base portion defining a clasp plane. The respective ends of the wire are then bent toward one another in the clasp plane approximately midway between the base portion and the free end to form respective second bends with a second bend angle of about 45°. The respective ends of the wire are then bent in the clasp plane about one third of the way between the second bend and the free end to form a third bend having a third bending angle of about 135°. The bending procedure provides a clasping portion wherein the respective spherical beads are disposed adjacent to the first bend at the respective ends of the base portion.

In essence, the money clip comprises a single length of bent spring wire having two opposing free ends wherein each of the free ends have a spherical bead affixed thereto. The spring wire preferably has a length of about 35 cm and an outer diameter of about 0.2 cm. Each spherical bead has an axial bore therein with an axial bore diameter greater than or equal to the outer diameter of the wire and an outer diameter of preferably about 0.5 cm. The wire has a base portion defined as a centrally located portion of the wire that is straight and has a length preferably between 4-5 cm. The remainder of the wire on each side of the base portion is bent in a plane that includes the base portion to form a clasping portion adjacent to base portion. The bending angles used to form the clasping portion may vary considerably. In a preferred embodiment, the clasping portion of the money clip is formed by bending each of the respective lengths of wire laterally disposed with respect to said base portion to make a first bend having a first bending angle of about 60° with respect to the base portion; the plane containing the two free ends of the bent wire and the base portion defining a clasp plane. The respective ends of the wire are then bent toward one another in the clasp plane at a point located approximately midway between the base portion the said free end to form respective second bends with a second bend angle of about 45°. The length of wire adjacent to the free ends of the wire are then bent a third time in the clasp plane at a point disposed about one third of the way between the second bend and the free end to form a third bend having a third bending angle of about 135°. In the clasping portion thus formed, the spherical beads are disposed adjacent to the first bends and respective ends of the base portion. A flap portion comprising a disc-shaped, partially laminate member formed of two disc-shaped sheets of a flexible material adhered to one another on one half of the flap portion and separated from one another on an opposing half of said flap portion, is affixed to the base portion. The portion of the flap portion comprising separated flexible material defines a pair of hinged leaves that envelop a portion of the clasping portion disposed adjacent the base portion. The flap portion preferably further includes visual indicia such as advertising imprinted thereon.

The features of the invention believed to be novel are set forth with particularity in the appended claims. However the invention itself, both as to organization and method of operation, together with further objects and advantages thereof may be best understood by reference to the following description taken in conjunction with the accompanying drawings.

DESCRIPTION OF THE PREFERRED EMBODIMENTS

Figure 1:
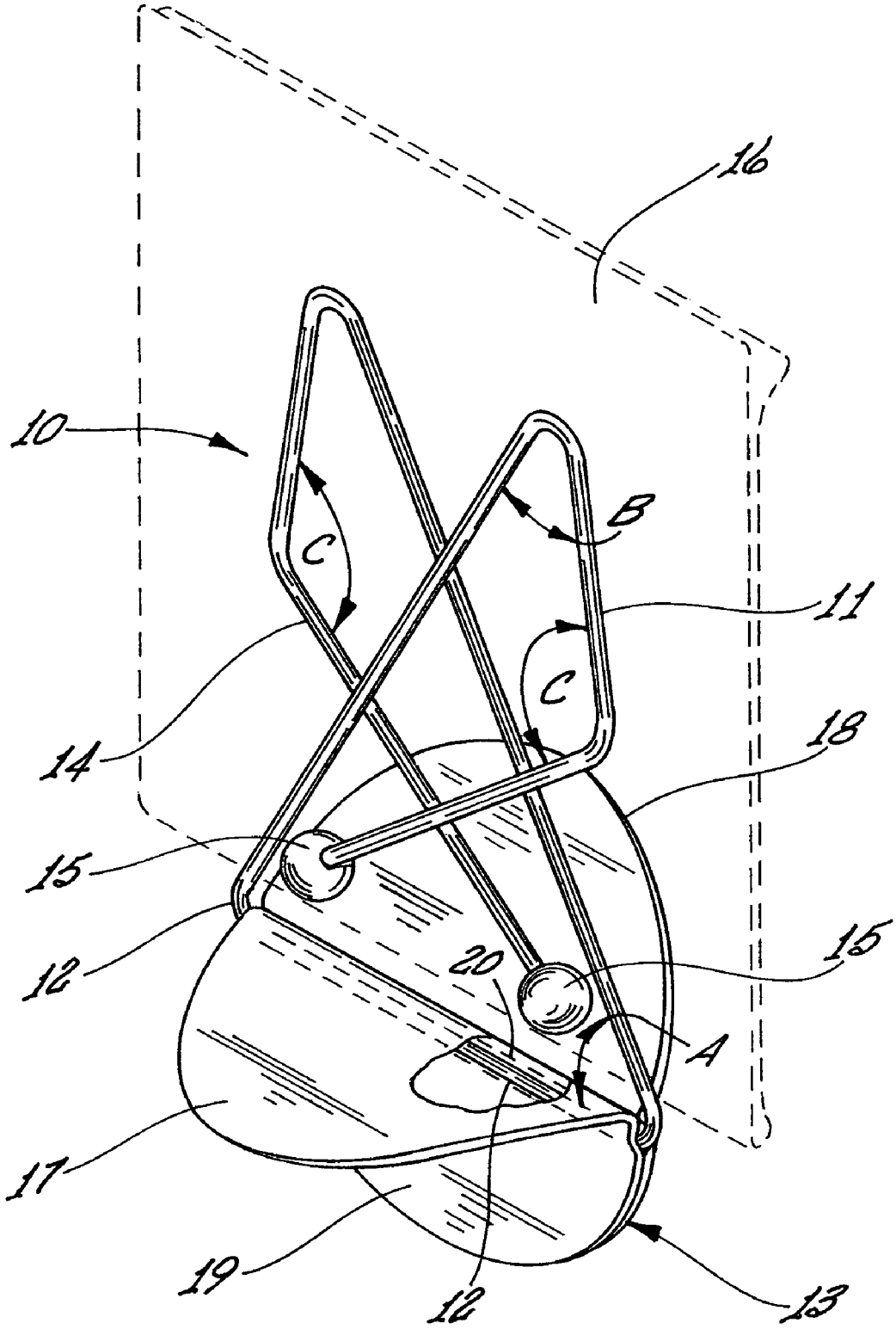
FIG. 1 is a perspective view of a money clip in accordance with the present invention.

A money clip in accordance with the present invention is shown in perspective view at numeral 10 in FIG. 1. The money clip 10 includes a clasping portion 11, a base portion 12 that is continuous with the clasping portion 11 and a flap portion 13. The clasp portion 11 includes a length of spring wire 14 (~35 cm) having an outer diameter preferably ~0.2 cm. The spring wire 14 has two free ends. Each of the free ends is terminated by a spherical bead 15 having an axial bore with a bore diameter greater than or equal to the outer diameter of the wire 14. The outer diameter of the bead 15 is preferably about 0.5 cm. The bead 15 is preferably attached to one of the free ends of the wire 14 by inserting the free end of the wire into the axial bore in the bead and affixing the bead thereto. The base portion 12 of the money clip 10 is defined as a portion of the wire 14 having a length preferably between 4-5 cm that is centered on the length of wire 14. The clasping portion 11 of the money clip is formed by bending the respective portions of wire laterally disposed with respect to the base portion to make a first bend having a first bending angle A of about 60° with respect to the base portion 12, the plane containing the center of the two beads 15 and the base portion 12 defining a clasp plane. The respective ends of the wire are then bent toward one another in the clasp plane at a point approximately midway between the edge of the base portion 12 and the free end to form respective second bends with a second bend angle B of about 45°. The respective ends of the wire are then bent in the clasp plane at a point located about one third of the way between the second bend and the free end to form a third bend having a third bending angle C of about 135°. The bending procedure provides a clasping portion 11 wherein the respective spherical beads 15 are disposed adjacent to the first bend at the respective ends of the base portion 12.

The beads 15 disposed on the free ends of the wire 14 provide additional grasping strength when one or more folded bills 16 (shown in phantom) are inserted into the grasping portion 11 and the folded edge of the bills advanced into the clasping portion until the fold in the bills is adjacent to the base portion 12. It is found that after the bills 16 are inserted into the clasping portion 11 as described above, the folded edge of the bills 16 can rotate away from the base portion 12 while the money clip is in the user's pocket and may even come out of the clasping portion. Surprisingly, it has been found that the affixation of a flap portion 13 to the base portion 12 reduces the tendency of the folded edge of the bills 16 to move away from the base portion 12.

The flap portion 13 is disc-shaped and comprises two layers 17 and 18 of a flexible material laminated to one another on one half of the flap portion 13, the laminated half of the flap portion 13 indicated at numeral 19. The layers 17 and 18 are separated from one another on the opposing half of the flap portion 13. To attach the flap portion to the base portion, the flap portion is placed over the base portion with the upper layer 17 above the base portion and the lower layer 18 below the base portion such that the base portion is adjacent to the laminated portion 19. A row of stitches or an adhesive is applied to attach the upper layer 17 to the lower layer 18 adjacent the base portion thereby sandwiching the base portion therebetween and affixing the flap portion to the base portion. The unlaminated portion of the flap portion 13 provides flaps that partially envelop the clasping portion adjacent to the base portion. The flap portion reduces the tendency of the folded edge of the bills to move relative to the base portion.

While particular embodiments of the present invention have been illustrated and described, it would be obvious to those skilled in the art that various other changes and modifications can be made without departing from the spirit and scope of the invention. For example, although exemplary dimensions suitable for a money clip have been disclosed, it is obvious to the skilled artisan that the dimensions such as the length and diameter of the wire, the diameter of the bead and the bend angles may be varied to suit other applications such as providing a clip for organizing lottery tickets, business cards or other paper products. It is therefore intended to cover in the appended claims all such changes and modifications that are within the scope of this invention.

I claim:

1. A money clip operable for holding one or more folded bills of paper currency comprising a single length of bent spring wire having two opposing free ends wherein each of said opposing free ends have a spherical bead affixed thereto, wherein said spring wire has a length of about 35 cm and an outer diameter of about 0.2 cm, wherein each said spherical bead has an axial bore therein with an axial bore diameter greater than or equal to said outer diameter of said wire and wherein each said bead has an outer diameter of about 0.5 cm, wherein said wire has a base portion defined as a portion of said wire having a length between 4-5 cm centered on said length of said wire and a clasping portion adjacent said base portion, wherein said clasping portion of said money clip is formed by bending each respective portions of said wire laterally disposed with respect to said base portion to make a first bend having a first bending angle of about 60" with respect to said base portion, the plane containing said two free ends and said base portion defining a clasp plane; then bending said free ends of said wire toward one another in the clasp plane at a point located approximately midway between said base portion and said free end to form respective second bends with a second bend angle of about 45'; then bending said free ends of said wire in the clasp plane at a point disposed about one third of the way between said second bend and said free end to form a third bend having a third bending angle of about 135'such that said spherical beads are disposed adjacent to said first bend and said base portion, wherein a flap portion is affixed to said base portion, said flap portion comprising a discshaped, partially laminate member formed of two disc-shaped sheets of a flexible material adhered to one another on one half of the flap portion and separated from one another on an opposing half of said flap portion, said separated flexible material defining a pair of leaves that envelop a portion of said clasping portion disposed adjacent said base portion.

2. The money clip of claim 1 wherein said flap portion further includes visual indicia such as advertising imprinted thereon.

* * * * *